US006828920B2

(12) United States Patent
Owen et al.

(10) Patent No.: US 6,828,920 B2
(45) Date of Patent: Dec. 7, 2004

(54) SYSTEM AND METHOD FOR CLASSIFYING VEHICLES

(75) Inventors: Donald K. Owen, Leawood, KS (US); Dale M. Klamer, Olivenhain, CA (US)

(73) Assignee: Lockheed Martin Orincon Corporation, San Diego, CA (US)

( * ) Notice: Subject to any disclaimer, the term of this patent is extended or adjusted under 35 U.S.C. 154(b) by 0 days.

(21) Appl. No.: 10/160,569

(22) Filed: May 31, 2002

(65) Prior Publication Data

US 2003/0011492 A1 Jan. 16, 2003

Related U.S. Application Data

(60) Provisional application No. 60/295,626, filed on Jun. 4, 2001.

(51) Int. Cl.[7] ..... G08G 1/01

(52) U.S. Cl. ..... 340/941; 340/933; 340/934; 705/13; 235/384

(58) Field of Search ..... 340/941, 933, 340/934; 705/13; 235/384

(56) References Cited

U.S. PATENT DOCUMENTS

| | | | | |
|---|---|---|---|---|
| 5,247,297 | A | 9/1993 | Seabury et al. | |
| 5,278,555 | A | 1/1994 | Hoekman | |
| 5,321,615 | A | 6/1994 | Frisbie et al. | |
| 5,455,768 | A | 10/1995 | Johnson et al. | |
| 5,491,475 | A | 2/1996 | Rouse et al. | |
| 5,554,907 | A | 9/1996 | Dixon | |
| 5,663,720 | A | 9/1997 | Weissman | |
| 5,689,273 | A | 11/1997 | Bailey et al. | |
| 5,801,943 | A | 9/1998 | Nasburg | |
| 5,809,161 | A | 9/1998 | Auty et al. | |
| 5,877,705 | A | 3/1999 | Sampey | |
| 5,896,190 | A | 4/1999 | Wangler et al. | |
| 6,011,515 | A | 1/2000 | Radcliffe et al. | |
| 6,075,466 | A | 6/2000 | Cohen et al. | |
| 6,121,898 | A | 9/2000 | Moetteli | |
| 6,137,424 | A | 10/2000 | Cohen et al. | |
| 6,342,845 | B1 * | 1/2002 | Hilliard et al. | 340/941 |

FOREIGN PATENT DOCUMENTS

| | | |
|---|---|---|
| WO | WO95/28693 | 10/1995 |

OTHER PUBLICATIONS

International Search Report (and Notification of Transmittal) for PCT/US98/27706, dated Jun. 14, 1999.

* cited by examiner

*Primary Examiner*—Julie Lieu
(74) *Attorney, Agent, or Firm*—Gray Cray Ware & Freidenrich LLP

(57) ABSTRACT

A system and method have been provided for classifying electronic signatures, obtained through the detection of a vehicle with a single loop inductive sensor, into one of a plurality of vehicle classification groups. A neural networking process is able to learn the plurality of vehicle classifications. In response to an electronic signature stimulus, the neural networking process is able to recall the classification group corresponding to the signature.

31 Claims, 9 Drawing Sheets

Vehicle Classifications and Lengths

| | | |
|---|---|---|
| Class 1: Motorcycle | 5.6 feet | |
| Class 2: Passenger car | 17.4 feet | |
| Class 3: 2-axle, 4-tire single units | 19.1 feet | |
| Class 4: Buses | 41.7 feet | |
| Class 5: 2-axle, 6-tire single units | 29.0 feet | |
| Class 6: 3-axle single units | 34.0 feet | |
| Class 7: 4+ axle single units | 51.2 feet | |
| Class 8: 4 or less axle single trailers | 48.0 feet | |
| Class 9: 5-axle single trailer trucks | 62.4 feet | |
| Class 10: 6 or more axle single trailer trucks | 71.2 feet | |
| Class 11: 5 or less axle multi-trailer trucks | 70.0 feet | |
| Class 12: 6-axle multi-trailer trucks | 77.5 feet | |
| Class 13: 7 or more axle multi-trailer trucks | No Data | |
| Class 14: Class 2 + trailer | 27.4 feet | |
| Class 15: Class 3 + trailer | 39.1 feet | |
| Class 16: Class 5 + trailer | 44.0 feet | |
| Class 17: Class 6 + trailer | 63.0 feet | |
| Class 18: Loaded auto carrier | 83.1 feet | |
| Class 19: Empty auto carrier | 80.0 feet | |
| Class 20: Bobtail tractor | 24.0 feet | |
| Class 21: Combination tractor-trailer | 64.4 feet | |
| Class 22: 30-foot bus | 32.4 feet | |
| Class 23: 20-foot bus | 24.0 feet | |

FIG. 3

SYSTEM AND METHOD FOR CLASSIFYING VEHICLES

RELATED APPLICATIONS

This application claims priority of U.S. provisional patent application Ser. No. 60/295,626, filed on Jun. 4, 2001 the content of which is incorporated by reference herein.

This application contains information related to U.S. patent application Ser. No. 09/623,357, entitled "SYSTEM AND METHOD FOR CLASSIFYING AND TRACKING AIRCRAFT AND VEHICLES ON THE GROUNDS OF AN AIRPORT", filed on Aug. 30, 2000, which is the National Phase of PCT/US98/27706, filed on Jan. 9, 1998 and which is incorporated herein by reference.

BACKGROUND OF THE INVENTION

This invention relates generally to the detection of vehicles on a highway and, more particularly, to a system and method for classifying detected vehicles using a single sensor.

DESCRIPTION OF THE RELATED ART

As noted in U.S. Pat. No. 5,278,555 (Hoekman), vehicle detectors are commonly inductive sensors that detect the presence of conductive or ferromagnetic articles within a specified area. For example, vehicle detectors can be used in traffic control systems to provide input data to control signal lights. Vehicle detectors are connected to one or more inductive sensors and operate on the principle of an inductance change caused by the movement of a vehicle in the vicinity of the inductive sensor. The inductive sensor can take a number of different forms, but commonly is a wire loop which is buried in the roadway and which acts as an inductor.

The vehicle detector generally includes circuitry which operates in conjunction with the inductive sensor to measure changes in inductance and to provide output signals as a function of those inductance changes. The vehicle detector includes an oscillator circuit which produces an oscillator output signal having a frequency which is dependent on sensor inductance. The sensor inductance is in turn dependent on whether the inductive sensor is loaded by the presence of a vehicle. The sensor is driven as a part of a resonant circuit of the oscillator. The vehicle detector measures changes in inductance in the sensor by monitoring the frequency of the oscillator output signal.

A critical parameter in nearly all traffic control strategies is vehicle speed. In most circumstances, traffic control equipment must make assumptions about vehicle speed (e.g., that the vehicle is traveling at the speed limit) while making calculations. Systems to detect vehicles and measurement of velocity on a real-time basis continue to evolve. A single loop inductive sensor can be used for such a purpose if an assumption is made that all vehicles have the same length. The velocity of the vehicle may then be estimated based on the time the vehicle is over the loop. Using this method, the velocity estimate for any given vehicle will have an error directly related to the difference of the vehicle's actual length from the estimated length.

To improve accuracy, two loops (sensors) and two detector systems have been used in cooperation. These two-loop systems calculate velocity based upon the time of detection at the first loop, the time of detection at the second loop, and the distance between loops.

As noted in U.S. Pat. No. 5,455,768 (Johnson et al.), there are several systems that attempt to obtain information about the speed of a vehicle from a single detector. Generally, these system analyze the waveform of the detected vehicle to predict the speed of a passing vehicle. These systems estimate velocity independent of assumptions made concerning the vehicle length.

As noted in U.S. Pat. No. 5,801,943 (Nasburg), other technologies have been developed to replace loops. These sensors include microwave sensors, radar and laser radar sensors, piezoelectric sensors, ultrasonic sensors, and video processor loop replacement (tripwire) sensors. All of these sensors typically detect vehicles in a small area of the roadway network.

Video processor loop replacement sensors, also known as tripwire sensors, simulate inductive loops. With a tripwire sensor, a traffic manager can designate specific small areas within a video camera's field of view. In use, a traffic manager typically electronically places the image of a loop over the roadway video. A video processor determines how many vehicles pass through the designated area by detecting changes within a detection box (image of a loop) as a vehicle passes through it. Like inductive loops, multiple tripwire sensors can be placed in each lane, allowing these systems to determine both vehicle counts and speeds.

Inexpensive RF transponders have been developed for use in electronic toll collection systems. When interrogated by an RF reader at the side of a roadway, RF transponders supply a unique identification signal which is fed to a processing station. It is understood that this system detects and identifies a given vehicle as it enters a toll area. After a vehicle is identified, the vehicle owner is debited for the proper amount of toll automatically.

Another technology being proposed for automated toll collection is the use of image processors to perform automated license plate reading. As with the RF transponders, a specific vehicle is identified by the system at the entrance to a toll road or parking area. Both the RF transponders and image processors provide vehicle identification and vehicle location information for a very limited area and have generally only been used for automatic debiting.

The multi-loop and complex sensors described above have the potential to supply useful information in the detection of vehicles. However, these sensors are typically expensive and would require significant installation efforts. Alternately stated, these sensors are largely unsupportable with the existing highway information single-loop infrastructure.

It would be advantageous if additional vehicle information could be derived from the single-loop sensor systems already installed in thousands of highways.

It would be advantageous if information from a single-loop sensor could be used to differentiate detected vehicles into classes of vehicles, such as passenger vehicles, trucks, multi-axle trucks, busses, and motorcycles.

It would be advantageous if the above-mentioned vehicle classification information could be used to accurately calculate vehicle velocities.

SUMMARY OF THE INVENTION

Accordingly, a method is provided for classifying or identifying a vehicle. The method comprises: establishing a plurality of classification groups; using a single inductive loop to generate a field for electrically sensing vehicles; measuring changes in the field; generating electronic signatures in response to measured changes in the field received from the single loop; analyzing the signatures; and classifying vehicles into a classification group in response to the analysis of the signatures.

In some aspects of the invention, establishing a plurality of vehicle classification groups includes establishing vehicle classifications selected from the group including passenger vehicles, two-axle trucks, three-axle vehicles, four-axle vehicles, five or more axle vehicles, buses, and motorcycles. Alternately, the classification can be based upon criteria such as vehicle mass, vehicle length, which is related to the number of axles, and the proximity of the vehicle body to the ground (the loop), which is an indication of weight.

Specifically, the method uses a neural network, which is a digital signal processing technique that can be trained to classify events. Therefore, the method includes an additional process of learning to form boundaries between the plurality of vehicle classification groups. Then, the analysis of the signatures includes recalling the boundary formation process when a signature is to be classified. The learning and recall processes are typically a multilayer perceptron (MLP) neural networking process.

In addition, the method further comprises: analyzing signatures to determine vehicle transition times across the loop; determining vehicle lengths in response to vehicle classifications; and calculating vehicle velocities in response to the determined vehicle lengths and the determined vehicle transition times.

Additional details of the above-described method and a system for classifying vehicles are presented below.

BRIEF DESCRIPTION OF THE DRAWING

FIG. 3 is a diagram illustrating an example set of vehicle classification groups.

DETAILED DESCRIPTION OF THE PREFERRED EMBODIMENTS

Figure 1:
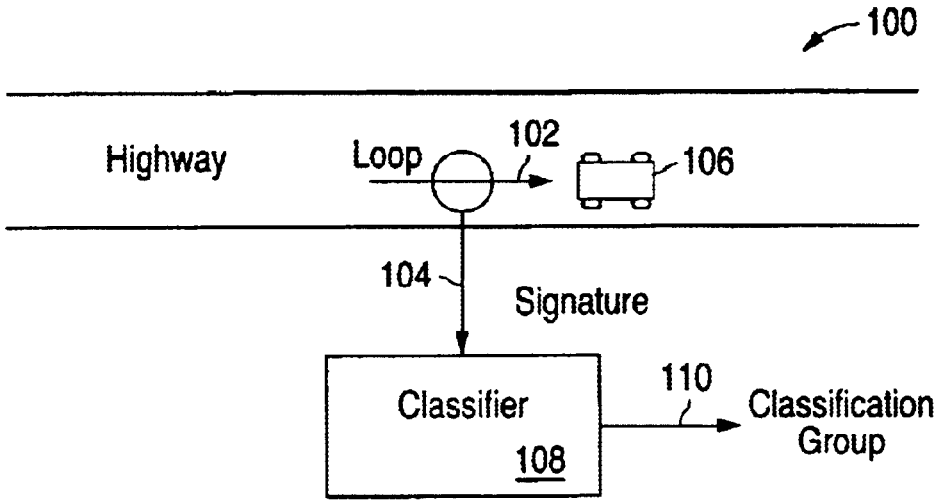
FIG. 1 is a schematic block diagram illustrating a system for classifying traffic on a highway.

FIG. 1 is a schematic block diagram illustrating a system for classifying traffic on a road or highway. The system 100 comprises a single sensor 102 positioned at a predetermined location along a highway, having a port on line 104 to supply an electronic signature generated in response to a proximal vehicle 106. A classifier 108 has an input connected to the sensor output on line 104 and an output on line 110 to supply a vehicle classification from a plurality of classification groups, in response to receiving the electronic signature on line 104.

Figure 2:
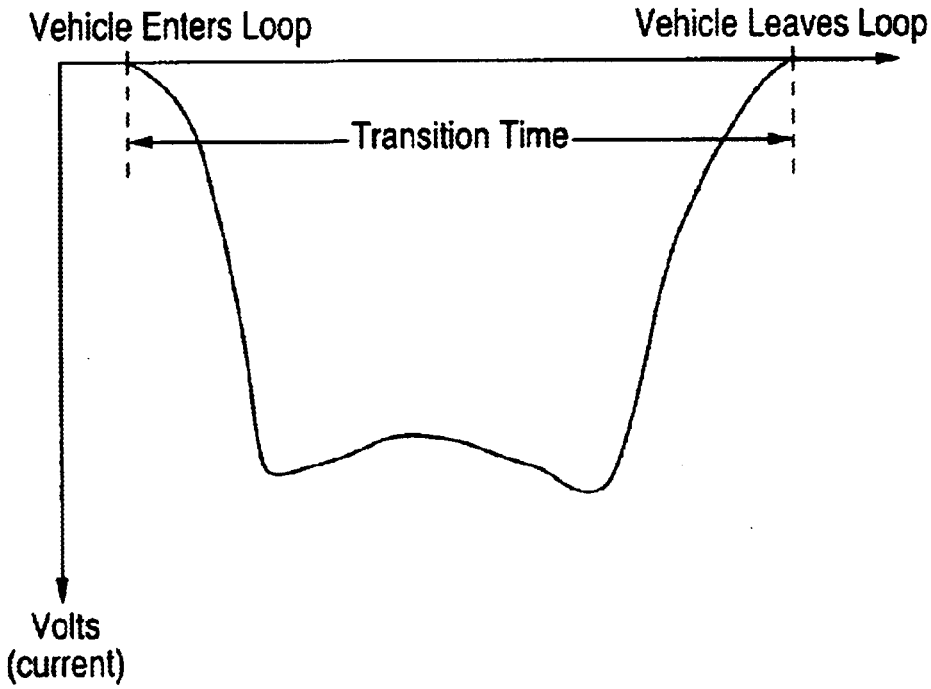
FIG. 2 is an example of an electronic signature.

FIG. 2 is an example of an electronic signature. As the vehicle 106 approaches the loop, the magnetic (or electrical) field generated by the loop begins to change. The maximum voltage (or current) deflection occurs as the vehicle passes over the loop. The signature generated by the change in voltage (current) is a function of the vehicle position and the composition of the vehicle. Each vehicle has a unique signature dependent upon characteristics such as the amount of metal in the vehicle, the type of metal, the length, width, and the road clearance of the vehicle, to name but just a few factors. In some aspects of the invention the signature is associated with the magnetic characteristics of a vehicle. Returning to FIG. 1, the sensor 102 receives a first electrical signal to generate a field. The signal can be generated internally, or supplied by another element such as the classifier. The sensor 102 supplies an electronic signature that is responsive to changes in the field. The changes in field are caused by the proximity and type of vehicle 106.

Typically, the sensor 102 is an inductive loop sensor to generate a field in response to electrical signals, and to supply an electrical signature responsive to changes in the field. Inductive loops are relatively simple and already exist in most major highways, either under the roadway or embedded in the material used to make the highway. The present invention, therefore, can be used for any highway with a preexisting loop, such as might to used to detect the presence of a vehicle at a signal light. However, other types of sensors may also be used. Inductive sensors in other shapes, or even non-inductive electrical sensors, working on different principles, that register mass, size, weight, or shape, may be used instead of an inductive loop.

FIG. 3 is a diagram illustrating an example set of vehicle classification groups. The classifier 108 classifies vehicles into vehicle classification groups including passenger vehicles, two-axle trucks, three-axle vehicles, four-axle vehicles, five or more axle vehicles, buses, and motorcycles. Further, the classifier 108 can classify vehicles into classification groups based upon criteria selected from vehicle length, the number of axles, and the number of tires. An analysis of the differences in signatures can determine if certain vehicles are lightly or heavily loaded, such as whether a car carrier is empty or loaded with vehicles.

Broadly, the classifier 108 uses a neural networking process to perform the classification. Therefore, the classifier 108 learns a process to form boundaries between the plurality of vehicle classification groups, and analyzes the signatures by recalling the boundary formation process. In this manner, the classifier 108 can make decisions to associate a signature with a vehicle classification group. Once a signature has been classified, the classifier 108 converts each classified vehicle decision into a symbol supplied at the output for storage, or for transmission to a higher level system element for analysis of traffic patterns. The vehicle class is typically communicated with a serial protocol, such as RS232 or the like.

As discussed in more detail below, several neural networking techniques exist, and there are specific advantages associated with each process. However, the multilayer perceptron neural networks has been found to be particularly effective.

In addition to assigning signatures to classification groups, the classifier can also determine the vehicle speed.

The classifier 108 determines vehicle lengths in response to vehicle classifications, as can be seen in FIG. 3. The classifier determines vehicle transition times across the sensor, from analyzing the electronic signature, and calculates vehicle velocities in response to determining vehicle length and the vehicle transition time (see FIG. 2). It is also an aspect of the invention that a vehicle can be classified from analysis of a signature of a vehicle that is stopped over, or partially over, a sensor.

Figure 4:
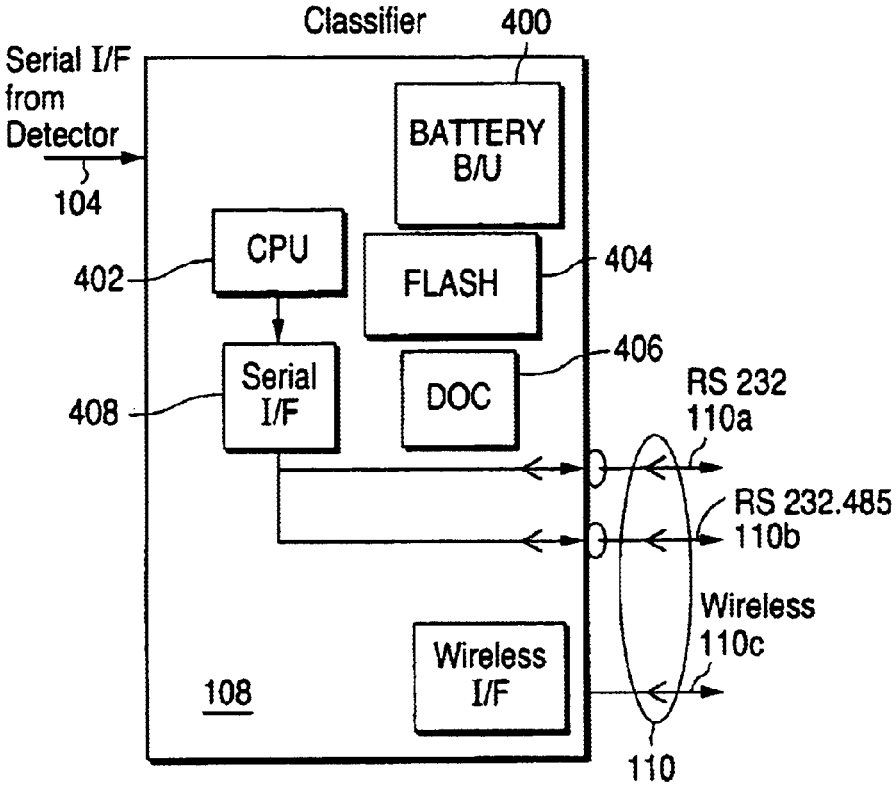
FIG. 4 is a more detailed depiction of the classifier of FIG. 1.

FIG. 4 is a more detailed depiction of the classifier 108 of FIG. 1. The classifier receives signatures on line 104 from the sensor, which can also be referred to as a detector. The power can be supplied externally, or from an internal battery. As shown, a battery 400 is used for back up (B/U) power. Communications on line 110 can be in accordance with serial communications, such the RS 232 and RS 232/485 protocols, or even parallel data protocols. However, as would be well known in the art, there are many other communication protocols that would be suitable. Alternately, the communication can be enabled through a wireless link using either a data or voice channel protocol. A clock signal can be internally derived or supplied from the communications link on line 110. A digital signal processor (DSP) or central processing unit (CPU) 402 performs the classification function, generates statistics, and formats the collected data. Although the differences between a DSP and CPU are well in the art, they will both be generically referenced herein as a CPU for simplicity. The flash 404 is used to store code, code updates, the operating system, such as DOS, LINUX, or QNX, and the BIOS. Permanent storage on a chip (DOC) 406 permanently stores data. The serial I/F element 408 converts information to RS 232, RS 232/485 for communication with other system elements.

Figure 5:
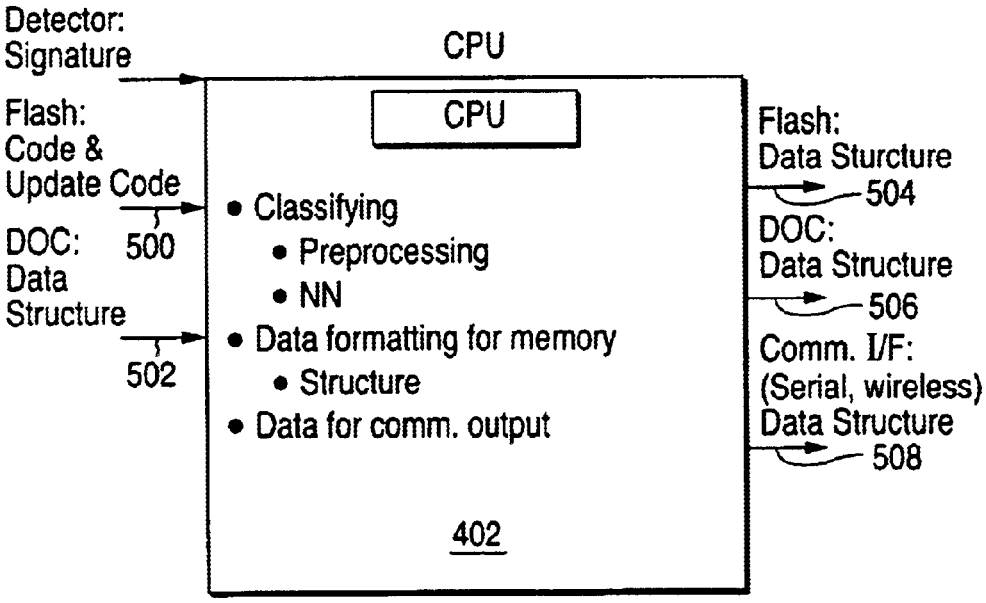
FIG. 5 is a more detailed depiction of the CPU of FIG. 4.

FIG. 5 is a more detailed depiction of the CPU 402 of FIG. 5. The CPU has inputs (not shown) to accept the clock and power. Shown are inputs on line 500 to accept the BIOS and operating system from flash. From the DOC 406, the classifier codes, classifier code updates, and data structure are accepted on line 502. Likewise, outputs on lines 504 and 506 are connected to flash and DOC, respectively, to provide short term and long term data structure. Serial data is output on line 508.

The classifier 108 outputs a data structure that includes information that is passed through the communication link (I/F) on line 110. It has a format equivalent to Table 1.

TABLE 1

DATA STRUCTURE

| Byte | Description | Length (bytes) |
|---|---|---|
| 1 | Header | 1 |
| 2 | Loop id | 1 |
| 3 | Gap | 1 |
| 4 | Speed | 1 |
| 5 | headway | 1 |
| 6 | signature | 3 |

The CPU 402 is not limited to any particular design or architecture. Obviously, a CPU with a higher operating speed multi-threading capability for the simultaneous processing of multiple channels, and an architecture with integrated functions (fewer commands) permits the signature analysis to be performed more quickly and simultaneously on multiple channels. In turn, a faster CPU may permit a more detailed or more complex analysis algorithm. In one aspect of the invention, a Motorola DSP 56300 24 bit processing family device is used, in particular the 56362 which operates as a 100 or 120 MHz processor. This processor is capable of 100 or 120 MIPS (2 56 bit MAC→20 MIPS or 120 MOPS) and permits parallel 24×24 bit MAC 1 in6 instruction (1 clock cycle/instruction), Hardware nested do loops, 24 bit internal data buss, 2 k×24 bit on chip Program RAM, 11 k×24 bit on chip Data RAM, 12 k×24 bit on chip Data ROM, and 192×24-bit bootstrap ROM. Alternately, a PowerPC 700CX processor (EBM) can be used operating at 550 MHz. The PowerPC device permits multi-threading, has a 32-bit data bus expandable to 64-bits, 32 k of L1 Cache, 256 of L2 Cache, and 32–64 bit registers for the floating unit. Other processors, or updated versions of the above-mentioned example processors could be adapted for the same purpose by those skilled in the art.

Figure 6:
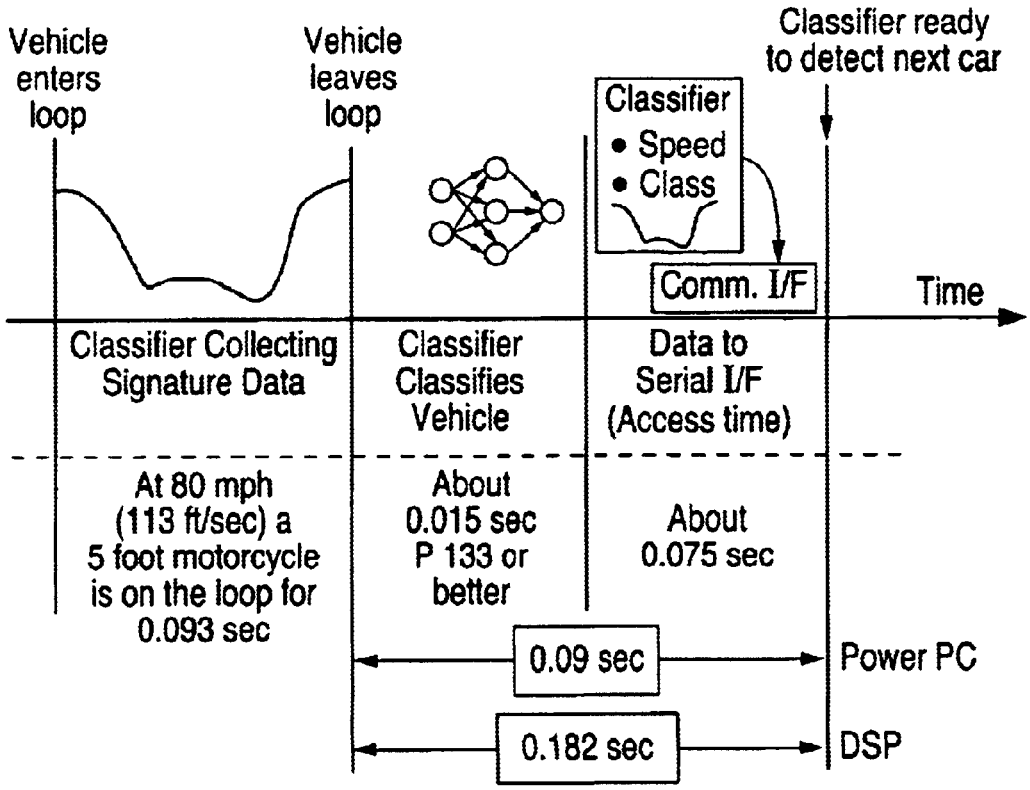
FIG. 6 is a diagram illustrating the allotted time processing requirements using a DSP and a PowerPC processor.

FIG. 6 is a diagram illustrating the allotted time processing requirements using a DSP and a PowerPC processor.

Neural networks originated as attempts to mimic the function of animal nervous systems, implemented as either hardware or software. While many network configurations are possible, they share the common features of being built up from simple processing elements and of being inherently parallel in operation by virtue of massive interconnectivity among large numbers of these elements. Neural networks are nonparametric and make weak or no assumptions about the shapes of the underlying distributions of the data. They have been successfully used as classifiers, multidimensional function approximators, and are a natural choice for data and multi-hypothesis fusion applications.

A neural network process was selected for the problem of classifying vehicle signatures because of its large decision space and its large feature space. The feature spaces have nonlinear boundaries that distinguish the different classes.

The advantages and limitations of neural networks are often complementary to those of conventional data processing techniques. The neural networks have been shown to be most useful in providing solutions to those problems for which: there is ample data for network training; it is difficult to find a simple first-principles or model based solution; and the processing method needs to be immune to modest levels of noise in the input data.

Moreover, calculation of the output of a trained neural network represents, in essence, several matrix multiplications. Thus, the model encoded in the network during the training process may be calculated quickly and with a minimum of computing power. This is a huge advantage of the neural approach and makes it particularly suitable for real-time applications and where the speed of processing is important.

Figure 7A:
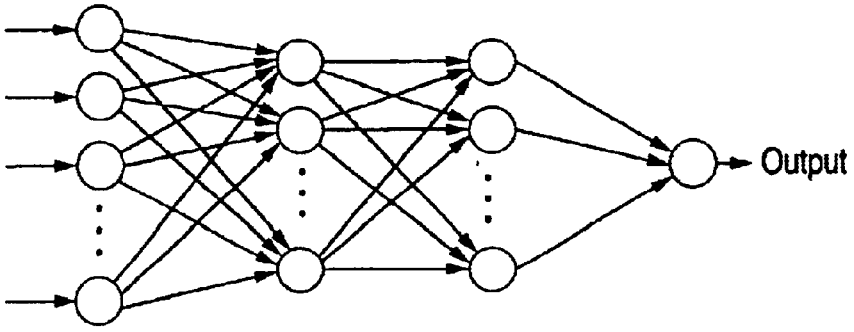
FIGS. 7*a* through 7*c* illustrate characteristics of a multilayer perceptron neural network.
Figure 7B:
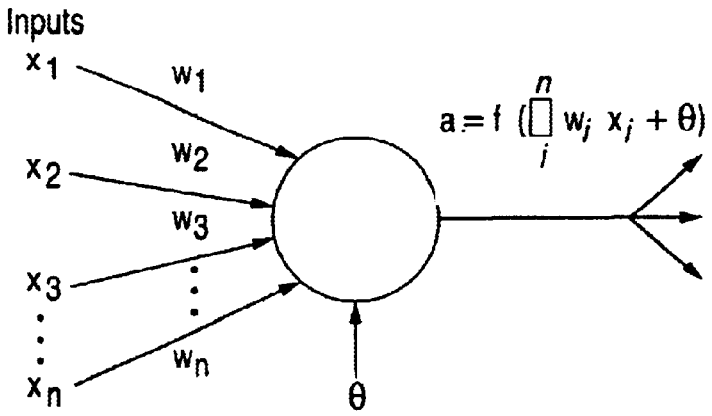
Figure 7C:
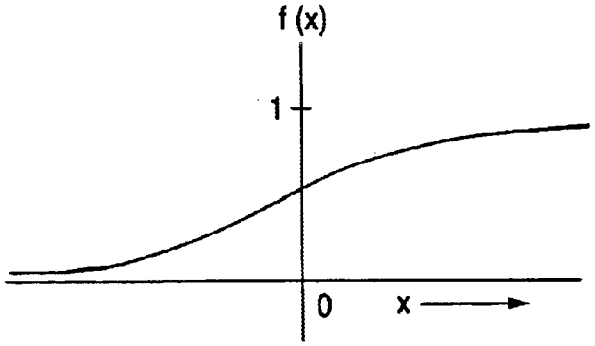

FIGS. 7*a* through 7*c* illustrate characteristics of a multilayer perceptron neural network. FIG. 7*a* depicts a neural network assembled by interconnecting layers of processing elements; FIG. 7*b* depicts a single processing element with multiple inputs $x_i$, input weights $W_i$, bias $\theta$, and output function a; and FIG. 7*c* depicts a sigmoid function (an example of function f as shown in FIG. 7*b*. As shown in FIG. 7*a*, the network consists of a large number of interconnected processing elements. As shown schematically in FIG. 7*b*, a processing element typically has many inputs that are processed into one or a few outputs. In FIG. 7*a*, the processing elements have been organized into three layers of processing nodes—two "hidden" layers and an output layer (the input elements are fan-out nodes rather than processing nodes and are not counted as a layer). This is a feed-forward configuration—connections run from an element in one layer to an element in the next layer in the direction of input to output. At the processing element level, each input $x_i$ is multiplied by an associated weight $W_i$, and the sum of weighted inputs and a constant bias θ is passed through a "squashing" function to the output. A typical sigmoid squashing function is shown in FIG. 7*c*. The squashing function accomplishes two important ends: it bounds the output value, and it introduces a nonlinearity. Due to the nonlinearity of the sigmoid applied at the processing elements, neural networks can capture a highly nonlinear mapping between the input and the output.

Neural networks are not so much programmed as trained by example. Training requires a set of "exemplars"—examples of inputs of known types, and their associated outputs. Inputs are presented to the network, processing elements perform their calculations, and output layer "activations" (the output values) result. An error measure is formed from the root-mean-square (rms) of all differences between activations and "truth" values (i.e., the known output of the mapping being trained for). Corrections to all the interconnection weights are estimated, and the weights are adjusted with the intent of lowering the overall rms error. The training process consists of repeating this cycle until the error has been reduced to an acceptably low level. The most popular algorithm for adjusting the weights is back-propagation, a gradient descent technique that seeks to minimize the total sum of the squared differences between the computed and desired responses of the network. Other techniques, including genetic algorithms, the conjugate gradient, and refinements of the back-propagation algorithm, are available and may be used to shorten the training time.

There are many important properties that a classifier must possess. These properties fall into two categories: learning and recall. "Learning" refers to how a system acquires and explains the class decision boundaries that are formed. "Recall" refers to the operation of the classifier once the decision boundaries have been formed (i.e., after training). These desirable properties are summarized in Table 2.

Figure 8A:
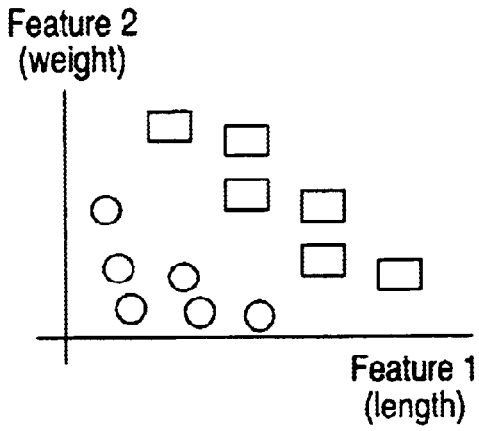
FIGS. 8*a* and 8*b* illustrate a simple two-dimensional feature space example of learning nonlinear decision boundaries.
Figure 8B:
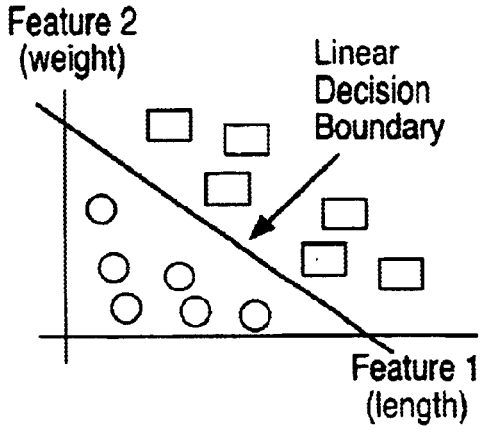

FIGS. 8*a* and 8*b* illustrate a simple two-dimensional feature space example of learning nonlinear decision boundaries. For example, Feature 1 can be the length of an object and Feature 2 can be the weight of an object. The "circles" plotted represent one category of objects and the "boxes" can represent a different category of objects. FIG. 8*a* depicts a two dimensional feature space example, and FIG. 8*b* depicts a linear decision boundary that separates the two object categories. One way to separate (classify) the two categories of objects is to draw a line between them (linear decision boundary) as shown in FIG. 8*b*.

TABLE 2

Desirable Classifier Properties.

| | |
|---|---|
| **Desirable Classifier Learning Properties** | |
| Nonlinear Classification | The ability to learn nonlinear decision boundaries is an important property for a classifier to have. The decision boundaries for the collision avoidance problem can be extremely complex and, when extending this problem to a high-dimensional feature space, this capability becomes critical. |
| Classify Multimodal Feature Space Distributions | In complex systems, a single class can be represented by many different feature vectors. It is desirable to have a classifier that can handle these various feature vector realizations a single class may exhibit. |
| Automatic Learning | The classifier will need to handle a massive amount of data. As such, the classifier should be able to automatically learn class decision boundaries from the data with minimal human intervention. |
| Incremental Learning | The classifier will need to be updated regularly and quickly. Many classifiers require complete retraining when new data is added. Complete retaining can be slow and require a great deal of storage for all the feature vectors, yet is typically done off-line and can easily be accommodated. |
| Minimal Tuning Parameters | All classifiers have some number of tuning parameters that are used to fine-tune the learning process. It is important that there be as few parameters as possible. Furthermore, the behavior that results from the adjustment of these parameters should be well understood. |
| Verification and Validation | The ability to explain the decision-making process is an important property for real-world systems. Because of the nature of the collision avoidance system problem, this capability is intensified. |
| Minimize Mis-classifications | The classifier should be capable of minimizing the misclassification rate when two classes overlap. |
| **Desirable Classifier Recall Properties** | |
| Graded Membership | A classifier should be able to report the degree to which a feature vector belongs to each of the classes in the system. |
| Novelty Detection | One interpretation of graded membership is the ability to perform novelty detection. Novelty detection refers to the ability to determine if the current feature vector sufficiently matches any of the known classes. |
| Incomplete Data | The classifier system will perform feature extraction from available data, but the data might be incomplete. A classifier should be capable of making a decision when a reasonable number of features are missing. |
| Class Generalization During Recall | Some classifiers have the ability to generalize, or increase the size of, class decision boundaries during recall. This is desirable when the training data does not represent test data well and when (re)training time intervals are lengthy. |
| Confidence Weighting | The ability to weight the confidence in extracted feature metrics is a desirable property for some classifiers. Some features are more reliable than others. Feature metrics with greater confidence can lead to decisions that are more reliable. |

Figure 9A:
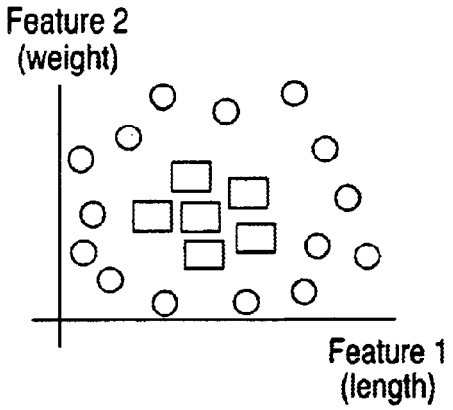
FIGS. 9*a* and 9*b* illustrate a "real world" problem that makes the implementation of neural networks difficult.
Figure 9B:
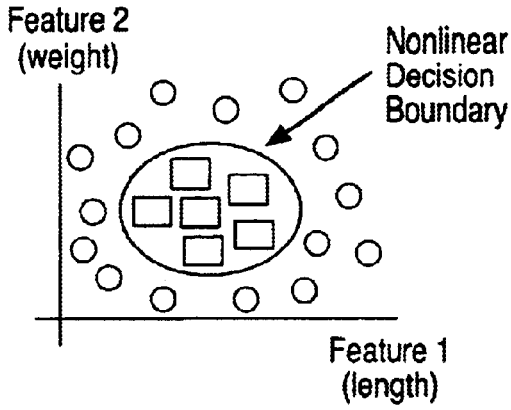

FIGS. 9*a* and 9*b* illustrate a "real world" problem that makes the implementation of neural networks difficult. FIG. 9*a* shows another simple two dimensional feature space example. Yet in this example, the best decision boundary to separate the two classes is not a line but an ellipse (nonlinear decision boundary) as shown in FIG. 9*b*. When extending this problem to a higher dimensional feature space, the capability to learn nonlinear decision boundaries often becomes critical to achieving good performance.

Table 3 provides a listing of notable vector classifiers with a discussion of how well they meet each of the properties discussed in Table 2. Two classifiers not listed in Table 3, the $k^{th}$-Nearest Neighbor and the Fisher Linear Discriminant, can be grouped under "classical" pattern recognition techniques, yet should still be considered as valid potential solutions to a classification problem. The classifiers listed in Table 3 are neural network classifiers, with the multilayer perceptron being one of the most widely studied and used in practice. The disadvantage column describes some traits, such as "processing missing and weighted features," as "difficult." Nevertheless, these difficulties can be overcome via model-based approaches to training or by selecting appropriate neural network parameters. Neural networks have added a new dimension to solving classification problems. Classical pattern recognition techniques have been used in the past by a small community, but since the advent of neural networks, many disciplines in science and engineering have ventured into this area because of the ease in training and implementing neural networks and also the powerful properties they exhibit. Many types of networks lend themselves to efficient parallel processing implementations with reasonable computational and memory requirements. They can be implemented by writing a neural network program to run on a personal computer and they can be implemented in hardware as a chip embedded with software instructions.

Figure 10:
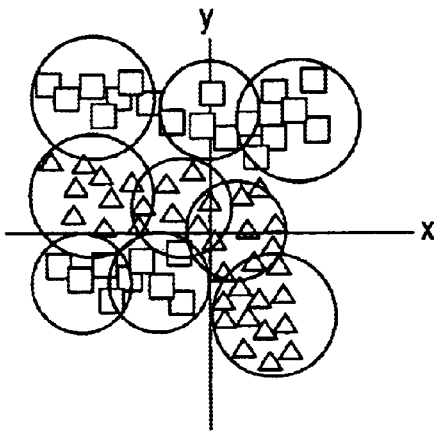
FIGS. 10 and 11 illustrate differing parsing systems for partitioning feature space.
Figure 11:
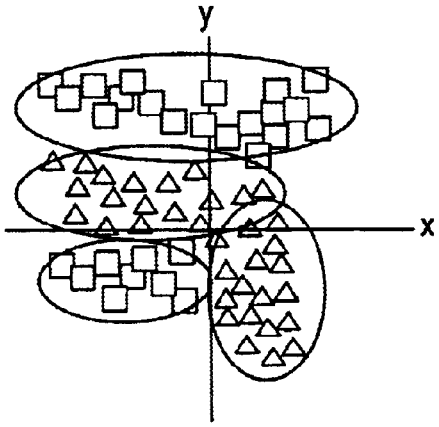

FIGS. 10 and 11 illustrate differing parsing systems for partitioning feature space. There are many types of neural networks that have been applied to many different problems. Yet they can be placed into two broad categories: clustering neural networks and error criteria minimization neural networks. Clustering neural networks attempt to parse up a feature space using some set of basis functions. FIGS. 10 and 11 are a good example of parsing the feature space into two sections. FIG. 10 depicts ten radial basis units to partition the feature space, and FIG. 11 depicts four elliptical basis units to partition the feature space. A good example of a clustering neural network is a Basis Function Classifier (BFC). Error criteria minimization neural networks operate on a training database and attempt to minimize the classification error between a true class vector and the neural network output. The most widely known network of this type is the Multilayer Perceptron (MLP).

As opposed to discussing neural networks in general, we will present some detail on the two above mentioned neural networks regarding architecture and training methods. Table 3 shows a brief comparison of these classifiers. The BFC provides useful information about how the decision boundaries are drawn. Real-world automatic classification systems, especially those that make decisions that lives and pocketbooks depend on, should be able to explain why a decision was made. Knowing these decision boundaries allows the basis function classifier to easily identify objects or events that are novelties, that is, different from the training set data. Novelty detection can be useful in flagging events not yet encountered. The MLP, in general, does not provide decision boundary information. The only way to obtain it is through extensive testing, and with a high-dimensional feature space, the task is all the more difficult. The BFC uses a basis function (a popular choice is a multivariate Gaussian density) that may be a poor basis function for the feature space; the MLP does not have this limitation and can draw any nonlinear decision boundary. The basis function classifier has a well-understood recall (during testing) parameter that allows the generalization of decision boundaries, the MLP does not. The MLP often requires less memory and is often more computationally efficient than the BFC.

The basis function classifier and MLP classifiers are similar as well. Both can learn nonlinear decision boundaries and have training parameters that aid in generalizing decision boundaries. Both also have a graded membership capability that enables them to report the degree to which a feature vector belongs to each of the classes in the system.

TABLE 3

Comparison of Basis Function Classifier and the Multilayer Perceptron Classifier

| Classifier | Brief Description | Advantages | Disadvantages |
|---|---|---|---|
| Basis Function Classifier Neural Network | Determines the H best mean vectors needed to represent the feature space spanned by a given set of input vectors, uses the mean vectors as the center of a basis function, and then forms linear combinations of these to make classification decisions. | Able to create nonlinear decision boundaries. Provides decision boundary information. Provides a graded membership and novelty detection. Decision boundary generalization parameters during training and recall. Framework allows the use of any basis function type. | The basis function selected may be a poor choice for the feature space. Clustering neural networks degenerate to a $k^{th}$ nearest neighbor classifier if all events in the classifier are very unique (k-basis units). |
| Multilayer Perceptron (MLP) Neural Network | A possible nonlinear mapping between feature vectors and classes is learned by performing a gradient descent in error space using the back-propagation algorithm. | Able to create nonlinear decision boundaries. Approaches Bayes decisions. Provides a graded membership. Decision boundary generalization parameters during training. | No generalization parameters during recall. Does not provide decision boundary information. Not able to perform novelty detection. |

With respect to the classification of vehicles, the MLP neural network processing method has generally been found to be most optimal considering the hardware available, practical software implementations, and the problems to be solved. The MLP process reduces the computational burden in using fewer multiply and addition operations than other neural network processes such as elliptical Basis Units. MLP has a structure that makes for easily implementable Dot product operations. However, as mentioned above, the other neural network processes have advantages that may make them more attractive for the solution of particular problems, as advances are made in hardware/software processing.

Figure 12:
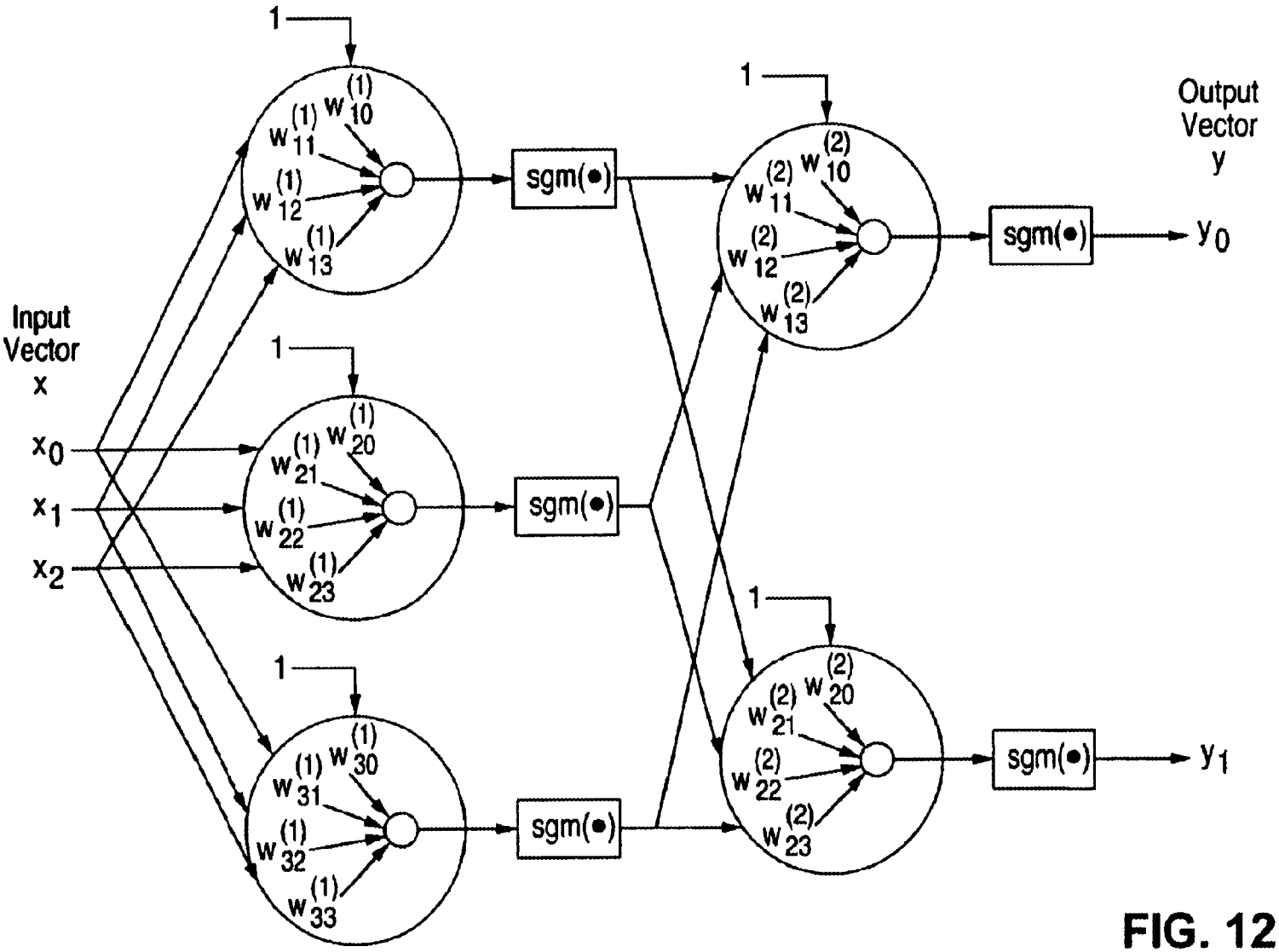
FIG. 12 is a block diagram of a multilayer perceptron neural network.

FIG. 12 is a block diagram of a multilayer perceptron neural network. This network has two functional layers of processing between the input and output, yet is often called a "three layer network" because the input is counted as a layer. It shows graphically the feed-forward operations of a two-layer network. The feed-forward operation for each node is given by $$y=sgm(w^T x+w_{bia}) \tag{1}$$

where w is the K∞1 adaptive weight vector, x is the K∞1 input vector, and $w_{bias}$ is the adaptive bias weight, y is the output, and $$sgm(x) = \frac{1}{1+e^{-x}}. \tag{2}$$

The most widely used and known training algorithm for MLP's is backpropagation. Before describing the algorithm, first some notation is provided for an MLP with three functional layers.

The square error derivative associated with the jth mode in layer 3 is defined as $$\delta_j^{(3)}=sgm'(s_j^{(3)})(d_j-y_j) \text{for } j=1 \text{ to } N_3 \tag{3}$$

where $d_j$ is the desired response from node j, $N_3$ is the number of nodes in layer 3, and $$sgm'(x) = \frac{d}{dx} sgm(x) = sgm(x)[1 - sgm(x)]. \tag{4}$$

The square error derivative associated with the j'th node in layer 2 is defined as $$\delta_{j'}^{(2)} = sgm'\left(s_{j'}^{(2)}\right) \sum_{j=1}^{Nodes3} w_{j,j'}^{(3)} \delta_j^{(3)} \text{ for } j' = 1 \text{ to } N_2 \tag{5}$$

where $N_2$ is the number of nodes in layer 2. The square error derivative associated with the j"th node in layer 1 is defined as $$\delta_{j''}^{(1)} = sgm'\left(s_{j''}^{(1)}\right) \sum_{j'=1}^{Nodes2} w_{j',j''}^{(2)} \delta_{j'}^{(2)} \text{ for } j'' = 1 \text{ to } N_1 \tag{6}$$

where $N_1$ is the number of nodes in layer 1.

Some trainers are designed so that a weight update occurs after all training templates are presented to the network (form of batch processing). The square error derivatives calculated in the trainer are actually the average of all the template's square error derivatives, e.g., $$\delta_m^{(l)} = \frac{1}{N_T} \sum_{n=0}^{N_T-1} \delta_m^{(l)}(n). \tag{7}$$

The instantaneous gradient vector estimate for node j in layer 3 with inputs from layer 2 is defined as $$\hat{\nabla}_j^{(3)} = -2\delta_j^{(3)} x^{(2)} = -2\delta_j^{(3)} \begin{bmatrix} x_1^{(2)} \\ x_2^{(2)} \\ \vdots \\ x_{N_2}^{(2)} \end{bmatrix}. \tag{8}$$

The instantaneous gradient vector estimate for node j' in layer 2 with inputs from layer 1 is defined as $$\hat{\nabla}_{j'}^{(2)} = -2\delta_{j'}^{(2)} x^{(1)} = -2\delta_{j'}^{(2)} \begin{bmatrix} x_1^{(1)} \\ x_2^{(1)} \\ \vdots \\ x_{N_1}^{(1)} \end{bmatrix}. \tag{9}$$

The instantaneous gradient vector estimate for or node j" in layer 1 with inputs from layer 0 (input vector) is defined as $$\hat{\nabla}_{j''}^{(1)} = -2\delta_{j''}^{(1)} x = -2\delta_{j''}^{(1)} \begin{bmatrix} x_1 \\ x_2 \\ \vdots \\ x_N \end{bmatrix}. \tag{10}$$

The most significant improvements are obtained by changing the way the weights update. The weight update equation for the original trainer at iteration k (layer and node notation dropped for convenience) is given by $$w_{k+1} = w_k + \Delta w_k \tag{11}$$

where $$\Delta w_k = \alpha \delta_k X_k \tag{12}$$

and $\alpha$ is a fixed parameter for all weights and is called the learning rate. Practical $\alpha$ values range from 0.01 to 1.0.

A simple improvement to speed up training is the implementation of an adaptive learning rate for each weight. The learning rate update equation is given by $$\alpha_{k+1} = \kappa\alpha_k \text{ if } \hat{\nabla}_k \hat{\nabla}_{k-1} > 0$$
$$\alpha_{k+1} = \lambda\alpha_k \text{ if } \hat{\nabla}_k \hat{\nabla}_{k-1} < 0 \tag{13}$$

where $\kappa$ is a constant greater than unity (typically 1.02) and $\lambda$ is a constant less than unity (typically 0.9). If the past and present instantaneous gradient estimates are of the same sign, this indicates that a minimum lies ahead and the learning rate should increase to speed up the learning. If the past and present instantaneous gradient estimates differ in sign, this indicates that a minimum is being jumped over and the learning rate should decrease to recover quickly. As known in the art, other methods to speed up MLP training are QuickProp, Delta-Bar-Delta, and ALECO.

Figure 13:
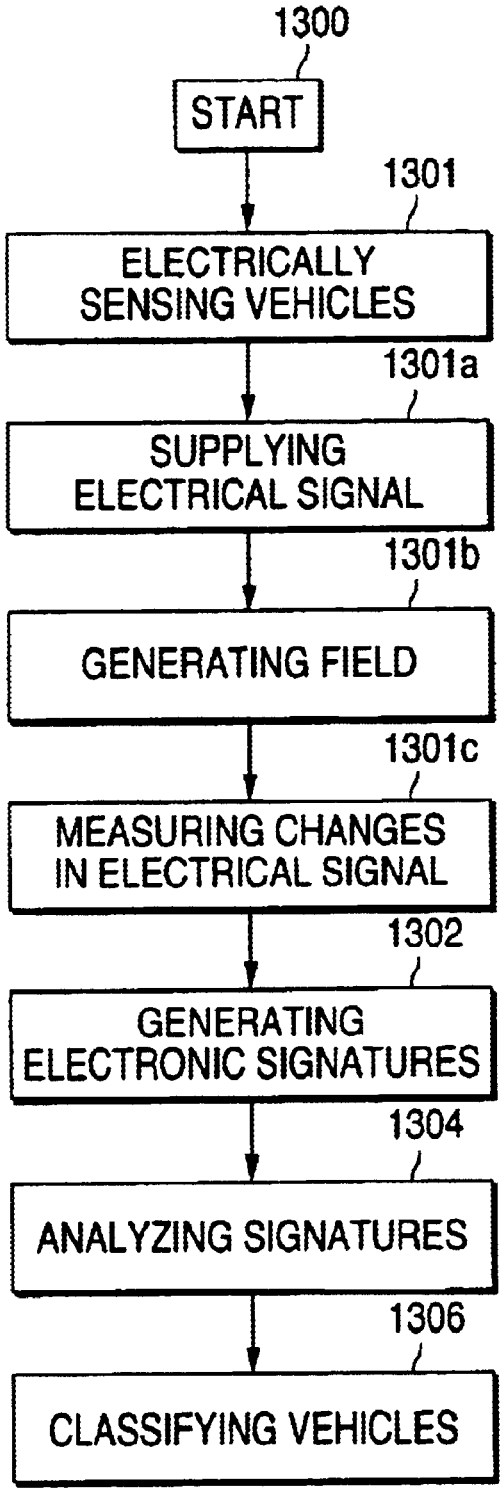
FIG. 13 is a flowchart depicting a method for identifying a vehicle.

FIG. 13 is a flowchart depicting a method for identifying a vehicle. Although the method is depicted as a sequence of numbered steps for clarity, no order should be inferred from the numbering unless explicitly stated. The method begins with Step 1300. Step 1302 generates electronic signatures in response to receiving data from a single sense point. Step 1304 analyzes the signatures. Step 1306 classifies vehicles in response to analyzing the signatures.

Step 1301 electrically senses vehicles at the single sense point. Generating electronic signatures in Step 1302 includes generating electronic signatures in response to sensing vehicles.

Electrically sensing vehicles at the single sense point in Step 1301 includes sub-steps. Step 1301*a* supplies an electrical signal. Step 1301*b* generates a field at the first sense point in response to the electrical signal. Step 1301*c* measures changes in the electrical signal in response to changes in the field. Generating electronic signatures in Step 1302 includes generating electronic signatures in response to the measured changes in the field.

In some aspects of the invention, electrically sensing vehicles at a single sense point in Step 1301 includes using a single loop inductive sensor as the sense point. Supplying an electrical signal in Step 1301*a* includes supplying an electrical signal to the inductive loop. Generating a field in response to the electrical signal in Step 1301*b* includes generating a field with the electrical signal supplied to the inductive loop.

Figure 14:
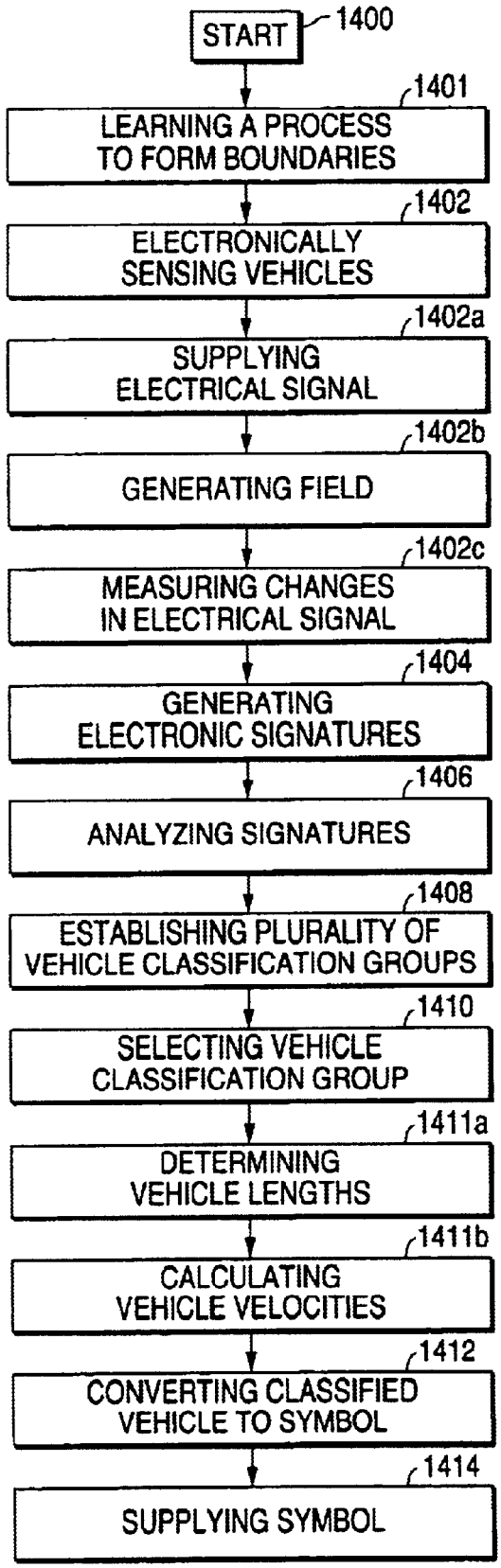
FIG. 14 is a flowchart illustrating additional details of the method of FIG. 13.

FIG. 14 is a flowchart illustrating additional details of the method of FIG. 11. The method begins with Step 1400. Step 1402 electrically senses vehicles at the single sense point using a single loop inductive sensor. Step 1402*a* supplies an electrical signal to the inductive loop. Step 1402*b* generates a field with the electrical signal supplied to the inductive loop. Step 1402*c* measures changes in the electrical signal in response to changes in the field. Step 1404 generates electronic signatures in response the measured changes in the field received from the single sense point sensing vehicles. Step 1406 analyzes the signatures. Step 1408 establishes a plurality of vehicle classification groups. Step 1410 selects a vehicle classification group in response to each analyzed signature.

In some aspects of the invention, establishing a plurality of vehicle classification groups in Step 1408 includes establishing vehicle classifications selected from the group including passenger vehicles, two-axle trucks, three-axle vehicles, four-axle vehicles, five or more axle vehicles, buses, and motorcycles.

In some aspects, establishing a plurality of vehicle classification groups in Step 1408 includes establishing vehicle classifications based upon criteria selected from the group including vehicle length, which is related to the number of axles, and the proximity of the vehicle to the ground (the loop), which is an indication of weight.

Step 1401 learns a process to form boundaries between the plurality of vehicle classification groups. Analyzing the signatures in Step 1406 includes recalling the boundary formation process.

Selecting a vehicle classification group in Step 1410 includes making a decision to associate a signature with a vehicle classification group. Step 1412 converts the classified vehicle into a symbol. Step 1414 supplies the symbol for storage and transmission.

In some aspects of the invention, learning and recalling a process to form boundaries between the plurality of vehicle classification groups in Steps 1401 and 1406 includes using a multilayer perceptron neural networking process.

Step 1411*a* determines vehicle lengths in response to vehicle classifications. Step 1411*b* calculates vehicle velocities following the determination of vehicle length.

In some aspects of the invention, analyzing signatures in Step 1406 includes determining vehicle transition times across the single sense point. Calculating vehicle velocities in Step 1411*b* includes calculating velocities in response to the determined vehicle lengths and the determined vehicle transition times.

A system and method have been provided for identifying vehicles with a single inductive loop. Examples have been given of highway applications, but the invention is generally applicable to any system that seeks to identify passing objects with an inductive, or alternate sensing detector. Other variations and embodiments will occur to those skilled in the art.

We claim:

1. A method for identifying a vehicle, the method comprising:

generating electronic signatures in response to receiving data from a single sense point;

analyzing the signatures with a neural network trained to distinguish different vehicle classifications having nonlinear decision boundaries; and classifying vehicles in response to analyzing the signatures.

2. The method of claim 1 further comprising:

electrically sensing vehicles at the single sense point; and wherein generating electronic signatures includes generating electronic signatures in response to sensing vehicles.

3. The method of claim 2 wherein electrically sensing vehicles at the single sense point includes:

supplying an electrical signal;

generating a field at the single sense point in response to the electrical signal; and in response to changes in the field, measuring changes in the electrical signal; and wherein generating electronic signatures includes generating electronic signatures in response to the measured changes in the field.

4. The method of claim 3 wherein electrically sensing vehicles at the single sense point includes using a single loop inductive sensor as the single sense point;

wherein supplying an electrical signal includes supplying an electrical signal to the single loop inductive sensor; and wherein generating a field in response to the electrical signal includes generating a field with the electrical signal supplied to the single loop inductive sensor.

5. The method of claim 1 further comprising:

determining vehicle lengths in response to vehicle classifications.

6. The method of claim 5 further comprising:

following the determination of vehicle length, calculating vehicle velocities.

7. The method of claim 6 wherein analyzing signatures includes determining vehicle transition times across the single sense point; and wherein calculating vehicle velocities includes calculating velocities in response to the determined vehicle lengths and the determined vehicle transition times.

8. A method for identifying a vehicle, the method comprising:

supplying an electrical signal to a single loop inductive sensor located at a single sense point;

generating a field with the electrical signal supplied to the single loop inductive sensor;

in response to changes in the field caused by vehicles proximate the single sense point, measuring changes in the electrical signal;

generating electronic signatures in response the measured changes in the field;

analyzing the electronic signatures with a neural network trained to distinguish different vehicle classifications having nonlinear decision boundaries; and selecting, from a plurality of vehicle classification groups, a vehicle classification group in response to each analyzed signature.

9. The method of claim 8 wherein the plurality of vehicle classification groups includes vehicle classifications selected from the group including passenger vehicles, two-axle trucks, three-axle vehicles, four-axle vehicles, five or more axle vehicles, buses, and motorcycles.

10. The method of claim 8 wherein the plurality of vehicle classification groups includes vehicle classifications based upon criteria selected from the group including vehicle mass, vehicle length, and the proximity of the vehicle to the single loop inductive sensor.

11. A method for identifying a vehicle, the method comprising:

learning a process to form boundaries between a plurality of vehicle classification groups;

generating electronic signatures in response to receiving data from a single sense point;

analyzing the signatures; and classifying vehicles in response to analyzing the signatures;

wherein analyzing the signatures includes recalling the boundary formation process.

12. The method of claim 11 wherein classifying vehicles includes making a decision to associate a signature with a vehicle classification group.

13. The method of claim 12 further comprising:

converting the classified vehicle into a symbol; and supplying the symbol for storage and transmission.

14. The method of claim 11 wherein learning and recalling a process to form boundaries between the plurality of vehicle classification groups includes using a multilayer perceptron (MLP) neural networking process.

15. A system for classifying traffic on a highway, the system comprising:

one or more sensors positioned at predetermined locations along a highway to generate a signal when a vehicle passes near a particular sensor; and a neural network configured to assign a classification to the vehicle in response to the signal generated by the particular sensor, the neural network being trained to distinguish different vehicle classifications having nonlinear decision boundaries.

16. The system of claim 15 wherein each sensor comprises an inductive loop.

17. The system of claim 15 wherein each sensor comprises an inductive loop underneath the highway.

18. The system of claim 15 wherein each sensor comprises an inductive loop embedded in material used to make the highway.

19. The system of claim 15 further comprising means for calculating the speed of a vehicle passing over an inductive loop.

20. A system for classifying traffic on a highway, the system comprising:

a single sensor positioned at a predetermined location along a highway, having a port to supply an electronic signature generated in response to a proximal vehicle; and a neural network based classifier having an input connected to the sensor port, and an output to supply a vehicle classification from a plurality of classification groups, in response to receiving the electronic signature, the neural network based classifier being trained to distinguish different vehicle classifications having nonlinear decision boundaries.

21. The system of claim 20 wherein the sensor receives an electrical signal to generate a field, and the sensor supplies an electronic signature that is responsive to changes in the field.

22. The system of claim 21 wherein the sensor is an inductive loop sensor configured to generate fields in response to electrical signals, and to supply electrical signatures responsive to changes in the fields.

23. The system of claim 22 wherein the classifier classifies vehicles into vehicle classification groups including passenger vehicles, two-axle trucks, three-axle vehicles, four-axle vehicles, five or more axle vehicles, buses, and motorcycles.

24. The system of claim 22 wherein the classifier classifies vehicles into classification groups based upon criteria selected from vehicle mass, vehicle length, the proximity of the vehicle to the sensor.

25. A system for classifying traffic on a highway, the system comprising:

a single sensor positioned at a predetermined location along a highway, having a port to supply an electronic signature generated in response to a proximal vehicle; and a classifier having an input connected to an output of the single sensor, and an output to supply a vehicle classification from a plurality of vehicle classification groups, in response to receiving the electronic signature;

wherein the classifier learns a process to form boundaries between the plurality of vehicle classification groups, and analyzes electronic signatures by recalling the boundary formation process.

26. The system of claim 25 wherein the classifier makes decisions to associate an electronic signature with a vehicle classification group.

27. The system of claim 26 wherein the classifier converts each classified vehicle decision into a symbol supplied at the output of the classifier.

28. The system of claim 26 wherein the classifier includes a multilayer perceptron neural network processor to learn and recall a process for forming boundaries between the plurality of vehicle classification groups.

29. The system of claim 20 wherein the classifier determines vehicle lengths in response to vehicle classifications.

30. The system of claim 29 wherein the classifier calculates vehicle velocities in response to determining the vehicle length.

31. The system of claim 30 wherein the classifier determines vehicle transition times across the sensor, from analyzing the electronic signature, and calculates vehicle velocities in response to determining vehicle length and the vehicle transition time.

* * * * *